US006341969B1

(12) United States Patent
Taniuchi et al.

(10) Patent No.: US 6,341,969 B1
(45) Date of Patent: Jan. 29, 2002

(54) ROTARY CONNECTOR

(75) Inventors: Ryoichi Taniuchi; Yoshiyuki Nakade; Takeo Nakamura; Ichiro Tateishi; Naoaki Matsui, all of Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/665,955

(22) Filed: Sep. 21, 2000

(30) Foreign Application Priority Data

Sep. 24, 1999 (JP) ..... 11-270806

(51) Int. Cl.[7] ..... H01R 35/04
(52) U.S. Cl. ..... 439/164; 439/15
(58) Field of Search ..... 439/164, 15

(56) References Cited

U.S. PATENT DOCUMENTS 4,744,763 A 5/1988 Suzuki et al.
5,226,831 A 7/1993 Horiuchi
5,772,456 A 6/1998 Ohishi
5,865,629 A 2/1999 Bernardini
5,944,544 A 8/1999 Kuroda et al.
6,116,930 A * 9/2000 Sakata ..... 439/164

* cited by examiner

*Primary Examiner*—P. Austin Bradley
*Assistant Examiner*—Ann McCamey
(74) *Attorney, Agent, or Firm*—Wenderoth, Lind & Ponack, L.L.P.

(57) ABSTRACT

A rotary connector, which is generally used for the steering device of an automobile, for establishing electrical connections via a flexible flat cable between an electric circuit fixed to the steering column and an electric circuit attached to the steering wheel. The rotary connector of the present invention has guiding means for the flat cable for smooth winding. Guide piece 13 is formed at recess 12C on inner cylinder 12B, with one end formed in one piece with the bottom surface of lid 12A of inner case 12. A proximity to the inside end of flat cable 5 is inserted into gap 14 between the inner wall of guide piece 13 and the periphery of recess 12C disposed on inner cylinder 12B of inner case 12. Flat cable 5 is then guided out from the edge surface of edge portion 13A formed so as to tilt the tip of guide piece 13 in the periphery direction. It is thus possible to provide an easy to assemble and economical rotary connector with the number of parts minimized.

12 Claims, 12 Drawing Sheets

ROTARY CONNECTOR

FIELD OF THE INVENTION

The present invention relates to a rotary connector used for the steering device of an automobile. More specifically, it relates to a rotary connector which establishes electric connections between an electric circuit secured to the steering column and an electric circuit attached on the steering wheel to be rotated, using a flexible flat cable.

BACKGROUND OF THE INVENTION

Conventionally, such a rotary connector described above, is made of following components:

(a) an outer case fixed to the steering column of an automobile;

(b) an inner case attached to the steering wheel shaft rotating with the steering wheel; and (c) a flat cable for establishing electric connections between the outer case side and the inner case side.

Such rotary connectors are broadly categorized into two types in terms of the winding way of the flat cable:

1. the winding that is spiral in one direction between the outer case and the inner case;
2. the winding that is reversed in direction at a midpoint of the flat cable.

Comparing two rotary connectors having a same outside dimension in which the flat cable is wound according to the two ways, the "reversed" winding can save the length of the flat cable, with reduced parts cost. The rotary connector with the "reversed" winding has therefore been popular in recent years.

Now will be explained about conventional rotary connectors with the flat cable spirally wound in one direction, referring to FIGS. 9 to 12.

FIG. 9 is a cross-sectional view and FIG. 10 is an exploded perspective view of a conventional rotary connector. The conventional rotary connector, as shown in FIGS. 9 and 10, comprises following components:

(a) cylindrical outer case 1 with the top and bottom surfaces open;

(b) inner case 2 accommodated in outer case 1 rotatably relative to outer case 1;

(c) cover 3 which is fixed to outer case 1 to cover the opening at the bottom of outer case 1; and (d) flexible flat cable 5 which is housed in ring-shaped space 4 between outer case 1 and inner case 2.

Inner case 2 is made of lid 2A which covers the top opening of outer case 1, and inner cylinder 2B having shaft hole 2C which protrudes downwardly from the center of the rear surface of lid 2A.

Ring-shaped space 4 is formed between inner wall 1A of outer case 1 and inner cylinder 2B of inner case 2. Wound in several turns, flat cable 5 is accommodated in space 4. Flexible flat cable 5 has band-shaped appearance, covering a plurality of conductive wires together. The inside end of flat cable 5 is connected to terminal 5A that is secured to inner case 2. Terminal 5A is further connected to inner connector 6. On the other hand, the outside end of flat cable 5 is connected to outer connector 7, which is fixed to outer case 1 and coupled to an external electric circuit.

In addition, elastic tongue-shaped piece 8, such as an insulating sheet, is attached to the inside end of flat cable 5. The end of tongue-shaped piece 8 is inserted in terminal 5A and is secured. A conventional rotary connector has such constitution described above. Outer case 1 of the rotary connector is fixed to a steering column (not shown) of an automobile. The steering wheel shaft (not shown) is inserted into shaft hole 2C of inner cylinder 2B of inner case 2. Formed in such structure described above, a conventional rotary connector is attached to the steering device of an automobile.

Outer connector 7, which is secured to outer case 1, is coupled to an electric circuit fixed to the steering column on the car body side. On the other hand, inner connector 6, which is secured to inner case 2, is coupled to an electric circuit within the steering wheel. In this manner, the electric connection between the steering wheel and the steering column is established via flat cable 5.

Now will be described how the rotation of steering wheel effects the winding state of flat cable 5 in the conventional rotary connector structured above.

FIG. 9 shows the state of flat cable 5 being wound evenly on the side of inner wall 1A of outer case 1 and the side of inner cylinder 2B of inner case 2. In this state, the steering wheel is held at a neutral position. Rotating the steering wheel from the neutral position rotates inner case 2 attached to the steering wheel shaft.

When the steering wheel is rotated in a clockwise direction, flat cable 5, shown in the cross-sectional view of FIG. 11, is wound on the side of inner cylinder 2B of inner case 2. In this case, flat cable 5 is wound more on the side of inner cylinder 2B than the side of inner wall 1A of outer case 1.

On the other hand, when the steering wheel is rotated, from the state shown in FIG. 9, in a counterclockwise direction, flat cable 5 is now wound more on the side of inner wall 1A, as shown in the cross-sectional view of FIG. 12. At this time, the inside end of flat cable 5 is guided by tongue-shaped piece 8. This protects flat cable 5 from buckling or deformation indicated by the broken line in FIG. 12.

As described above, the conventional rotary connector employs tongue-shaped piece 8 to prevent the inside end of flat cable 5 from buckling or deformation when the steering wheel is rotated in a counterclockwise direction. This, however, inconveniently not only increases the number of parts of the rotary connector but also consumes the time for assembling.

SUMMARY OF THE INVENTION

The present invention addresses the problems discussed above and aims to provide an economical and easy to assemble rotary connector with minimized number of parts.

To achieve the object described above, the rotary connector of the present invention comprises:

(a) a cylindrical outer case with the top and bottom surfaces open;

(b) an inner case accommodated in the outer case rotatably relative to the outer case, having a lid covering the top opening of the outer case and also having an inner cylinder protruding downwardly from the center of the rear surface of the lid;

(c) a cover fixed to the outer case covering the bottom opening of the outer case;

(d) a flexible flat cable housed in a ring-shaped space, with its inner and outside ends secured to inner and outer cases, respectively;

(e) a recess formed closely to where the inside end is fixed on the inner cylinder of the inner case;

(f) a guide piece formed at the recess so as to fit along the periphery of the inner cylinder, having its one end formed in one piece with the bottom surface of the lid of the inner case,; and (g) a gap formed between the inner wall of the guide piece and the periphery of the recess on the inner cylinder.

On the tip of the guide piece described above, an edge portion is formed so as to tilt in the direction of the periphery of the inner cylinder.

Besides, a portion adjacent to the inside end of the flat cable is passed through the gap, which is formed between the inner wall of the guide piece and the periphery of the recess on the inner cylinder. The flat cable is then guided out from the tilted edge portion of the guide piece. This guiding makes the flat cable abut against an R-shaped edge surface of the tilted edge portion of the guide piece when the flat cable is rewound. With slightly warped, the flat cable is unreeled from the side of the inner cylinder. The structure described above therefore not only protects the flat cable from buckling or deformation, but also minimizes the number of parts. It is thus possible to obtain an easy to assemble rotary connector with a low cost.

As a preferred embodiment, the rotary connector according to the present invention may employ a flat cable having an U-shaped reversed portion so that the winding of the flat cable on the side of the inner wall of the outer case is opposite in direction, via the reversed portion, to the winding on the side of the inner cylinder of the inner case. To be precise, a guide-ring having a guide-gap through which a reversed portion of the flat cable passes is accommodated, as well as the flat cable, in the ring-shaped space formed between the outer and inner cases such that the guide piece is rotatably relative to the outer case. The guide-ring reverses the winding direction of the flat cable in the space between the outer and inner cases, saving the length of the flat cable. It is thus possible to provide a cost-saved rotary connector.

Rotary Connector

DESCRIPTION OF THE PREFERRED EMBODIMENTS

Figure 1:
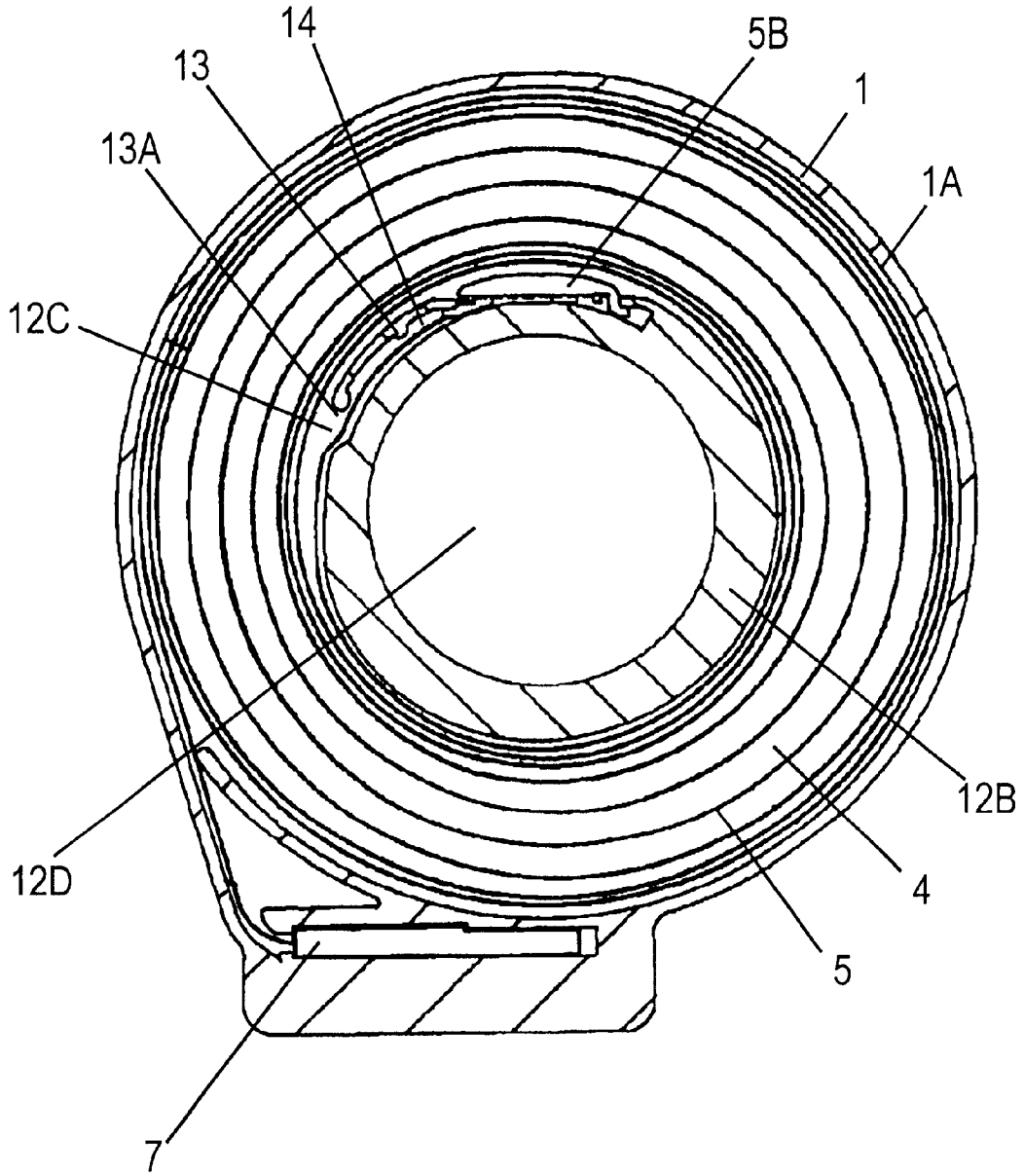
FIG. 1 shows a cross-sectional view of a rotary connector in accordance with a first preferred embodiment of the present invention.

The preferred embodiments of the present invention are described hereinafter with reference to the accompanying drawings, FIG. 1 through FIG. 8. Same parts as explained in the prior art are identified with same reference numerals, and their detailed description is omitted.

First Preferred Embodiment

Figure 2:
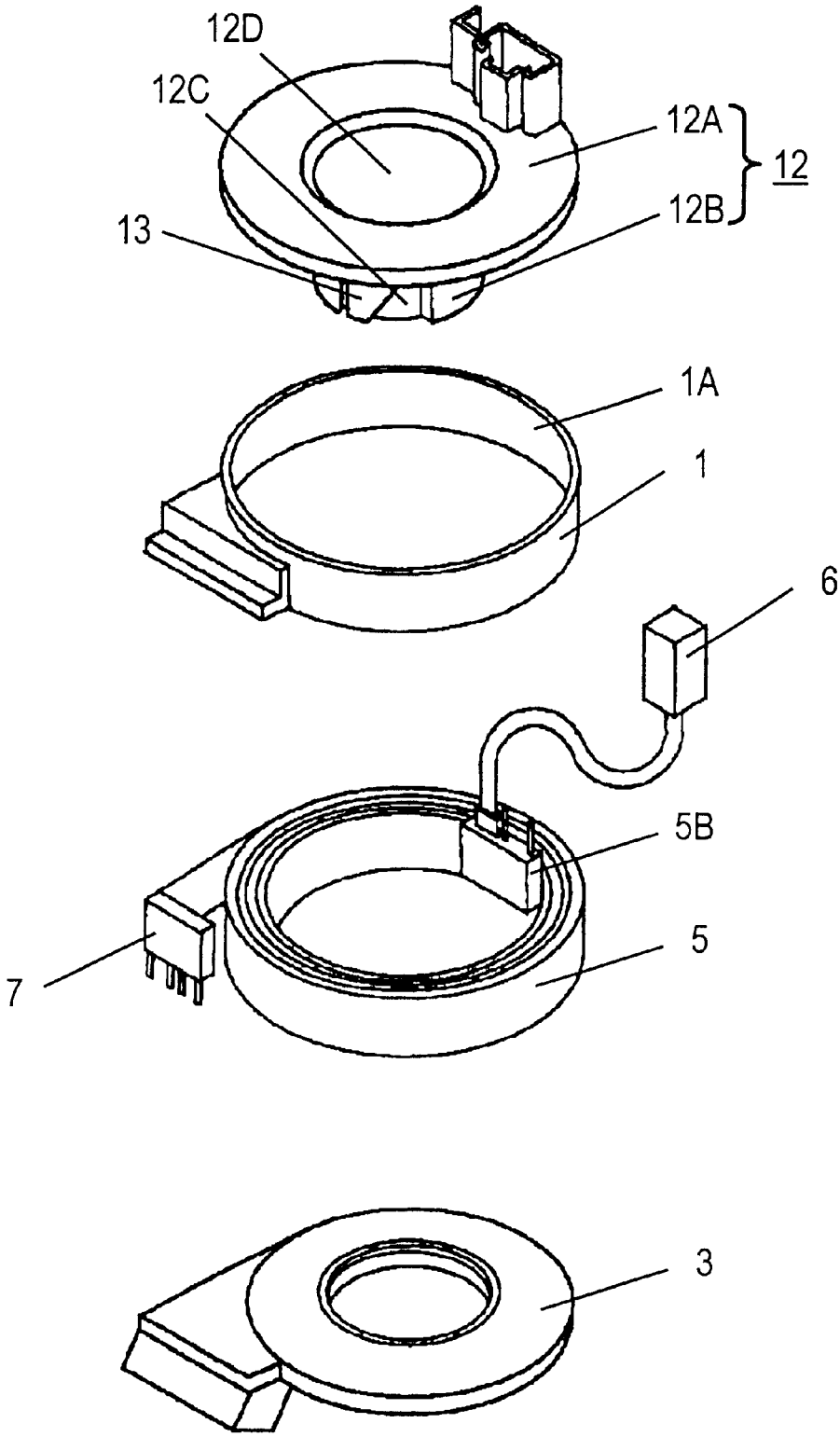
FIG. 2 shows an exploded perspective view of the rotary connector illustrated in FIG. 1.

FIG. 1 shows a cross-sectional view of a rotary connector in accordance with a first preferred embodiment of the present invention. FIG. 2 shows an exploded perspective view of the rotary connector illustrated in FIG. 1.

The rotary connector, shown in FIGS. 1 and 2, in accordance with the first preferred embodiment comprises:

(a) cylindrical outer case 1 with the top and bottom surfaces open;

(b) inner case 12 accommodated in the outer case 1 rotatably relative to outer case 1;

(c) cover 3 fixed to outer case 1 to cover the bottom opening of the outer case 1;

(d) flexible flat cable 5 housed in ring-shaped space 4, with its inside and outside ends secured to inner and outer cases, respectively;

(e) recess 12C formed closely to where the inside end of flat cable 5 is fixed on inner cylinder 12B of inner case 12;

(f) guide piece 13 formed at recess 12C, having its one end formed in one piece with the bottom surface of lid 12A of the inner case 12; and (g) gap 14 formed between the inner wall of guide piece 13 and the periphery of recess 12C on the inner cylinder.

The structure described below is the same as that in a conventional rotary connector:

(a) cylindrical outer case 1 with the top and bottom surfaces open;

(b) cover 3 fixed to outer case 1, covering the bottom opening of outer case 1;

(c) inner case 12 provided with lid 12A covering the top opening of outer case 1, and with inner cylinder 12B having shaft hole 12D protruding downwardly from the center of the rear surface of the lid 12A;

(d) flexible flat cable 5 which is wound in several turns and accommodated in ring-shaped space 4 that is formed between inner wall 1A of outer case 1 and inner cylinder 12B of inner case 12. Flat cable 5 has band-shaped appearance, covering a plurality of conductive wires together.

(e) terminal 5B fixed to inner case 12 is disposed at the inside end of flat cable 5;

(f) terminal 5B is coupled to inner connector 6;

(g) inner connector 6 is coupled to an electric circuit within the steering wheel;

(h) outer connector 7 fixed to outer case 1 is coupled to the outside end of flat cable 5; and (i) outer connector 7 is coupled to an external electric circuit.

In regard to the structure described above (a) through (i), there is no difference between the present invention and the prior art. The novelty in the rotary connector of the preferred embodiment is, however, in formation of recess 12C and guide piece 13. Recess 12C is formed on the outer wall of inner cylinder 12B of inner case 12, to be precise, recess 12C is formed closely to where the inside end of flat cable 5 is fixed on the inner cylinder 12B.

Figure 3:
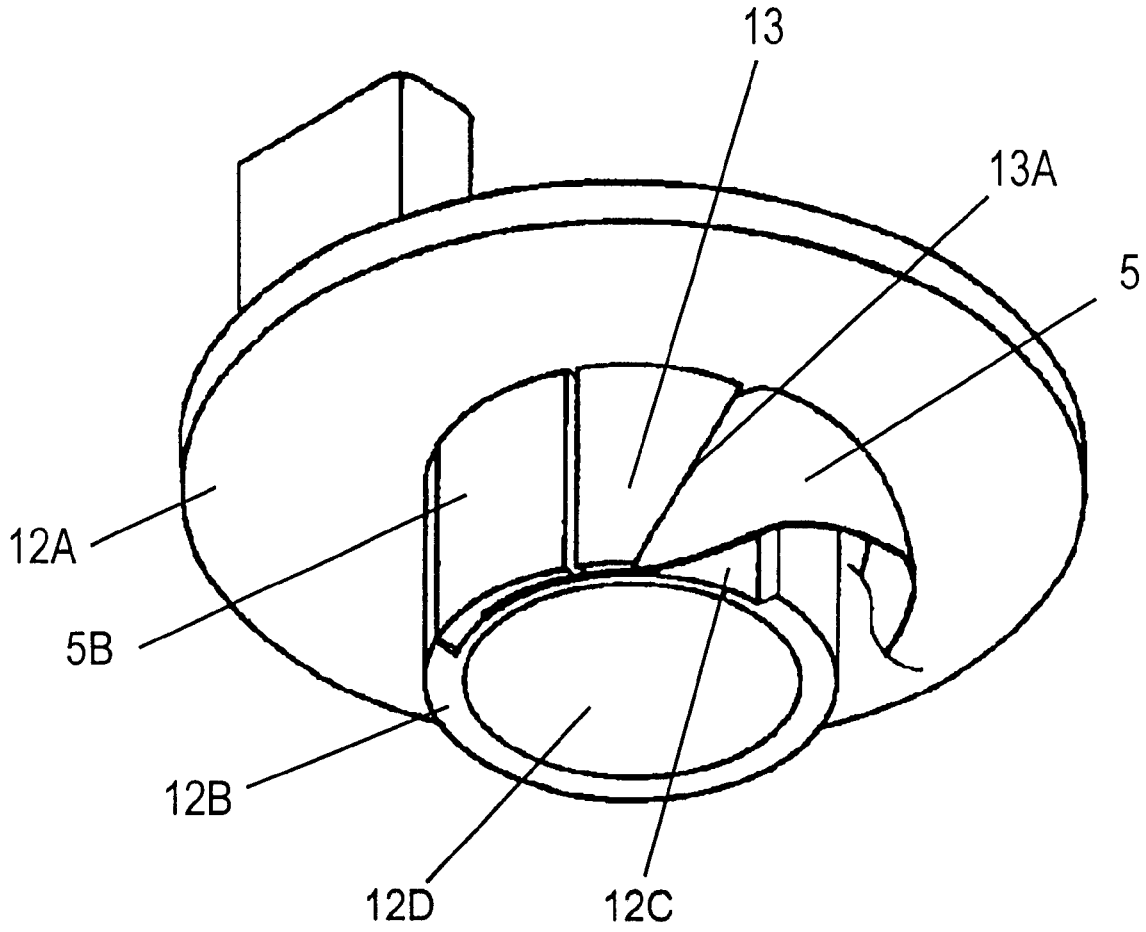
FIG. 3 shows a perspective view of the essential part of the rotary connector illustrated in FIG. 1.

In addition, guide piece 13 is disposed at recess 12C. One end of guide piece 13 is formed in one piece with the bottom surface of lid 12A of inner case 12. It may be formed in one piece with the periphery of inner cylinder 2B. The periphery of guide piece 13, which is shaped in a circular arc, is formed almost along the periphery of inner cylinder 12B. Edge portion 13A of circumferentially directed tip of guide piece 13 tilts in the periphery direction (FIG. 3). Besides, gap 14 is formed between the periphery of recess 12C and the inner wall of guide piece 13. A portion adjacent to the inside end of flat cable 5 is passed through gap 14. Flat cable 5 is then guided out from circumferentially tilted edge portion 13A of the tip of guide piece 13.

In the rotary connector of the first preferred embodiment structured above, outer case 1 is secured to the steering column (not shown) of an automobile. The steering wheel shaft (not shown) is inserted into shaft hole 12D of inner cylinder 12B of inner case 12. In this manner, the rotary connector of the first preferred embodiment is attached to the steering device in a car body. Outer connector 7, which is fixed to outer case 1, is coupled to an electric circuit in the steering column on the side of a car body, while inner connector 6, which is fixed to inner case 12, is coupled to an electric circuit within the steering wheel. An electric connection between the steering wheel and the steering column is thus established via flat cable 5. In regard to such workings, there is no difference between the present invention and the prior art.

Now will be described how the rotation of the steering wheel effects the winding state of flat cable 5 in the rotary connector structured above in accordance with the first preferred embodiment.

FIG. 1 shows the state of flat cable 5 being wound evenly on the side of inner wall 1A of outer case 1 and the side of inner cylinder 12B of inner case 12. In this state, the steering wheel is held at a neutral position.

Rotating the steering wheel from the neutral position rotates inner case 12 attached to the steering wheel shaft.

When the steering wheel is rotated in a clockwise direction, flat cable 5 is wound on the side of inner cylinder 12B of inner case 12. In this case, the winding of flat cable 5 is in a tightened state, being wound more on the side of inner cylinder 12B than the side of inner wall 1A.

On the other hand, when the steering wheel is rotated, from the state shown in FIG. 1, in a counterclockwise direction, flat cable 5 is now wound more on the side of inner wall 1A, that is, the winding of flat cable 5 is in a rewound state. The workings responsive to the rotation of the steering wheel are the same as those of the conventional rotary connector.

When flat cable 5 is rewound, however, it is guided out from the gap between circumferentially tilted edge portion 13A, which is formed on the tip of guide piece 13, and the periphery of recess 12C. This guiding makes the flat cable abut against the R-shaped edge surface of the edge portion of guide piece 13A when flat cable t is unreeled. With slightly warped, the flat cable is unreeled from the side of the inner cylinder 12B. Such structure relieves the stress applied to flat cable 5 at which the portion abuts against the R-shaped edge surface of edge portion 13A. With the stress relieved gradually, flat cable 5 is unreeled from the side of inner cylinder 12B to the side of inner wall 1A of outer case 1.

When the steering wheel is rotated in a counterclockwise direction, as described above, flat cable 5 abuts against the R-shaped edge surface of tilted edge portion 13A of guide piece 13. Then with slightly warped, flat cable 5 is unreeled from the side of inner cylinder 12B. According to the embodiment, it becomes possible not only to protect the flat cable from buckling or deformation, but also to realize an easy to assemble and economical rotary connector with a minimized number of parts.

Figure 4:
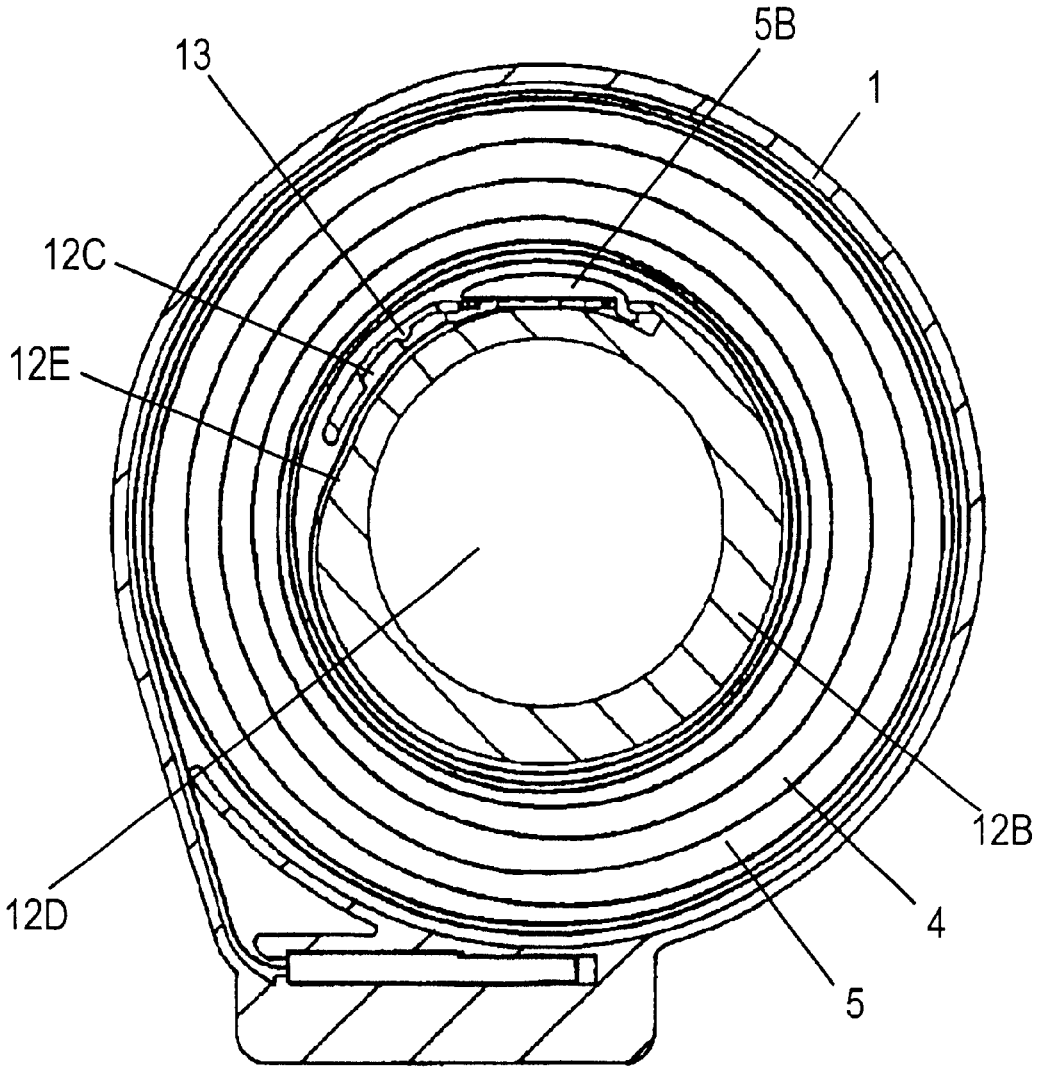
FIG. 4 shows a cross-sectional view of the rotary connector illustrated in FIG. 1, with its joint portion shaped linearly or in a circular arc.

As shown in the cross-sectional view of FIG. 4, joint 12E connecting the periphery of recess 12C of inner case 12 and the periphery of inner cylinder 12B is structured to be linear or rather circular arc with a gentle slope. With such structure, flat cable 5 is unreeled from the side of inner cylinder 12B, guided along the linear or circular arc shaped surface of joint 12E. This smoothly shaped joint 12E, shown in FIG. 4, applies a force evenly to the surface of flat cable 5 for smooth winding.

Figure 5:
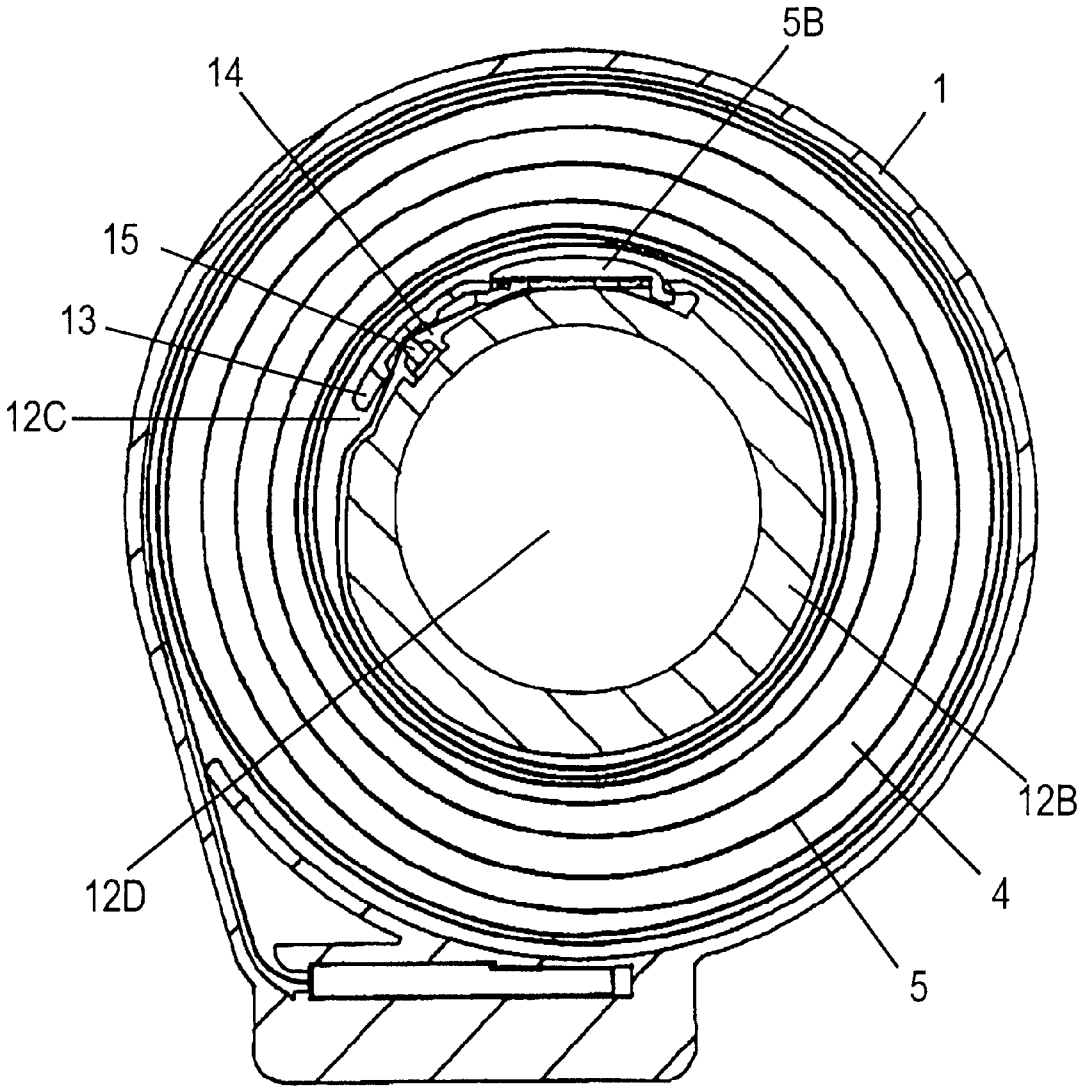
FIG. 5 shows a cross-sectional view of the rotary connector illustrated in FIG. 1, with a flexible member attached to the clearance.

As illustrated in the cross-sectional view in FIG. 5, elastic member 15, such as a rubber or other elastomer materials, is disposed in gap 14 between the periphery of recess 12C of inner case 12 and the inner wall of guide piece 13. With the help of elastic member 15, an area adjacent to the inside end of flat cable 5 resiliently abuts against guide piece 13. The abutment minimizes a rattle of flat cable 5 in gap 14, providing a smooth winding of flat cable 5 with no abnormal rattling sound.

Figure 6:
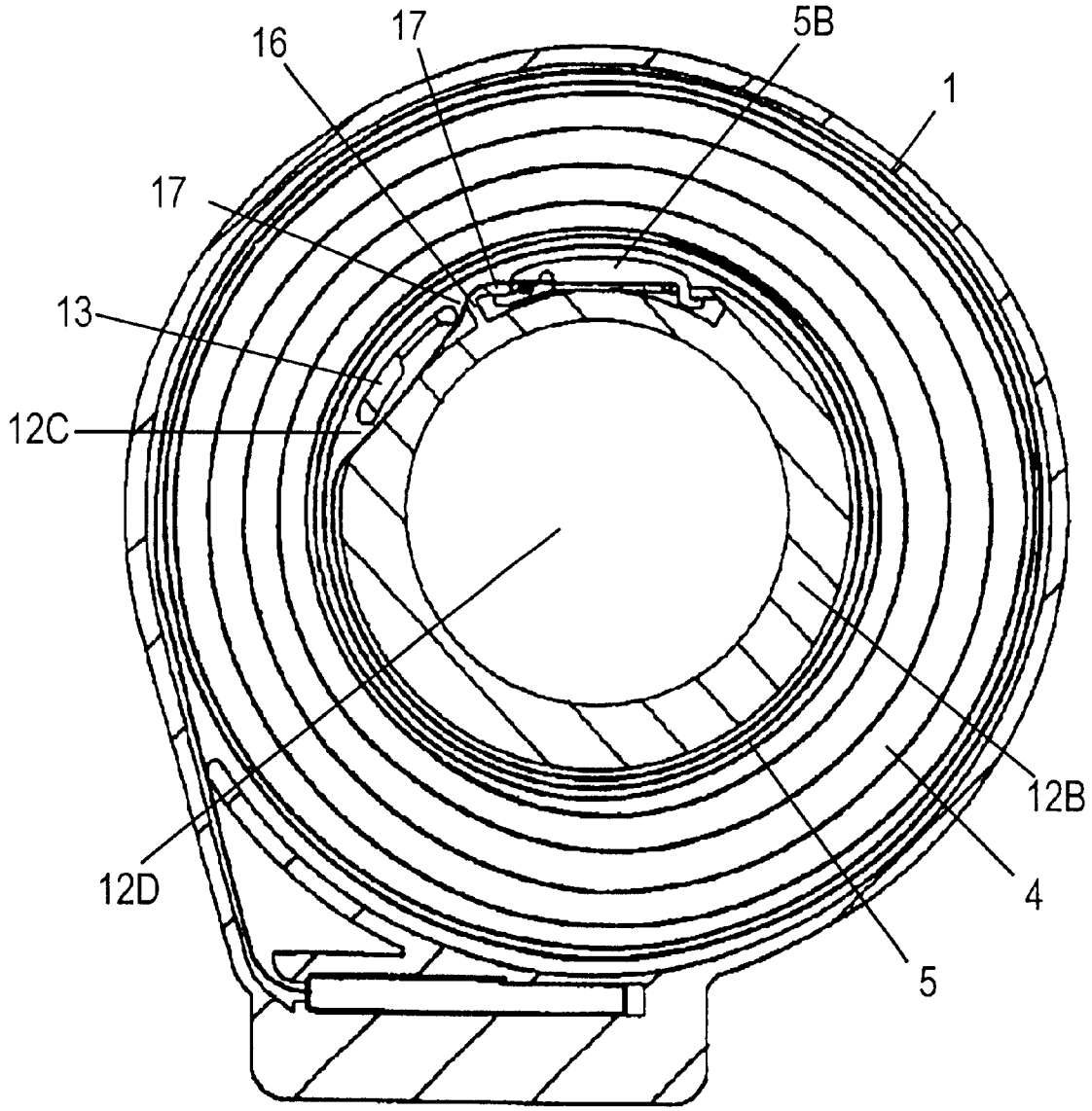
FIG. 6 shows a cross-sectional view of the rotary connector illustrated in FIG. 1, with a projected holder formed.

Besides, as shown in the cross-sectional view in FIG. 6, between terminal 5B and guide piece 13, projected holder 16 is disposed on the periphery of recess 12C on inner case 12. On the both sides of holder 16, exposed recess 17 is formed. With the structure, a proximity area to the inside end of flat cable 5 is held from terminal 5B along holder 16 and exposed recess 17. This arrangement increases the friction between the proximity area to the inside end of flat cable 5 and the periphery of recess 12C or the inner wall of guide piece 13. Therefore, a force, which is generated when rotating the steering wheel, applied to the inside end of flat cable 5 can be reduced.

Second Preferred Embodiment

Figure 7:
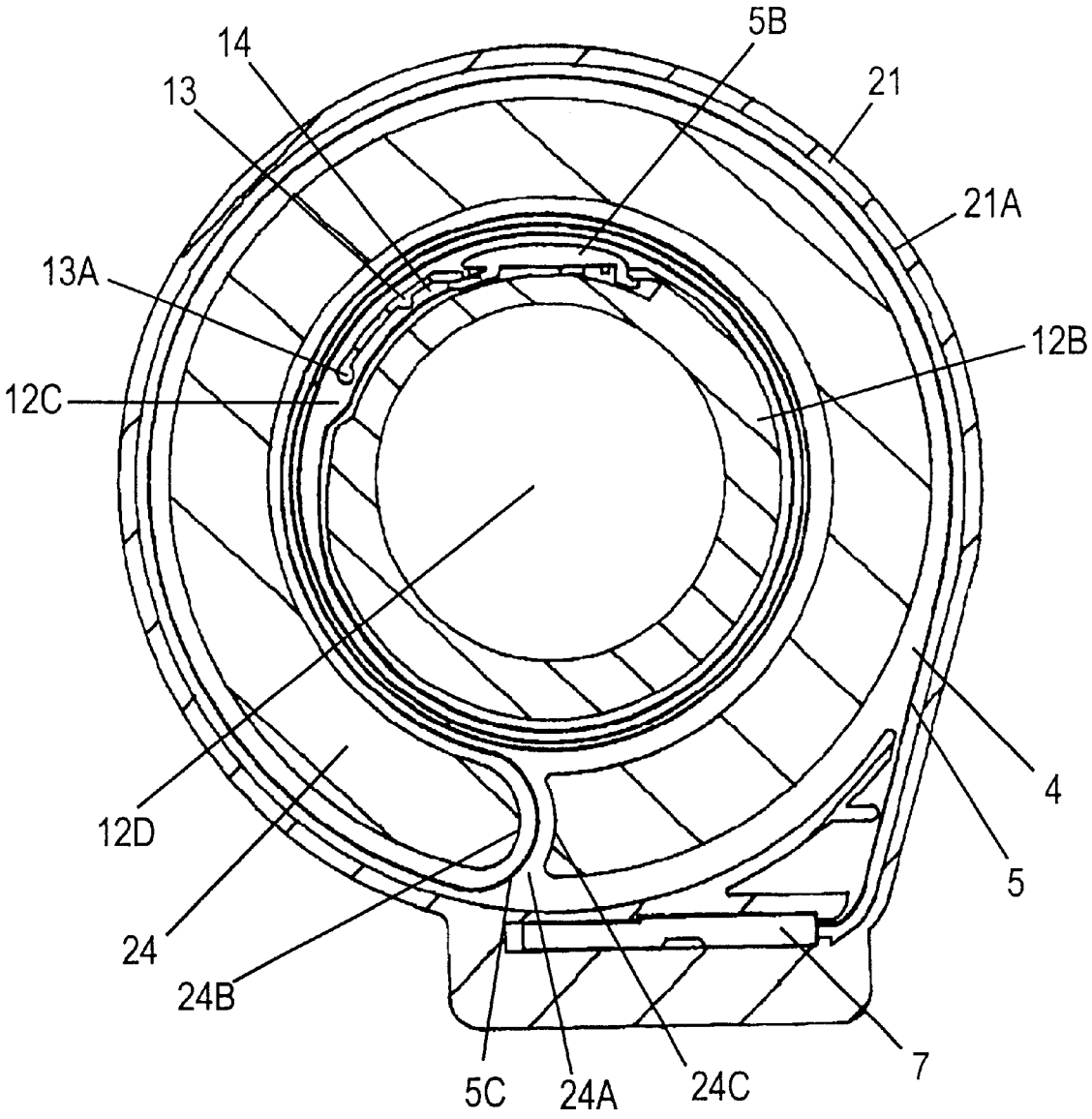
FIG. 7 shows a cross-sectional view of a rotary connector in accordance with a second preferred embodiment of the present invention.
Figure 8:
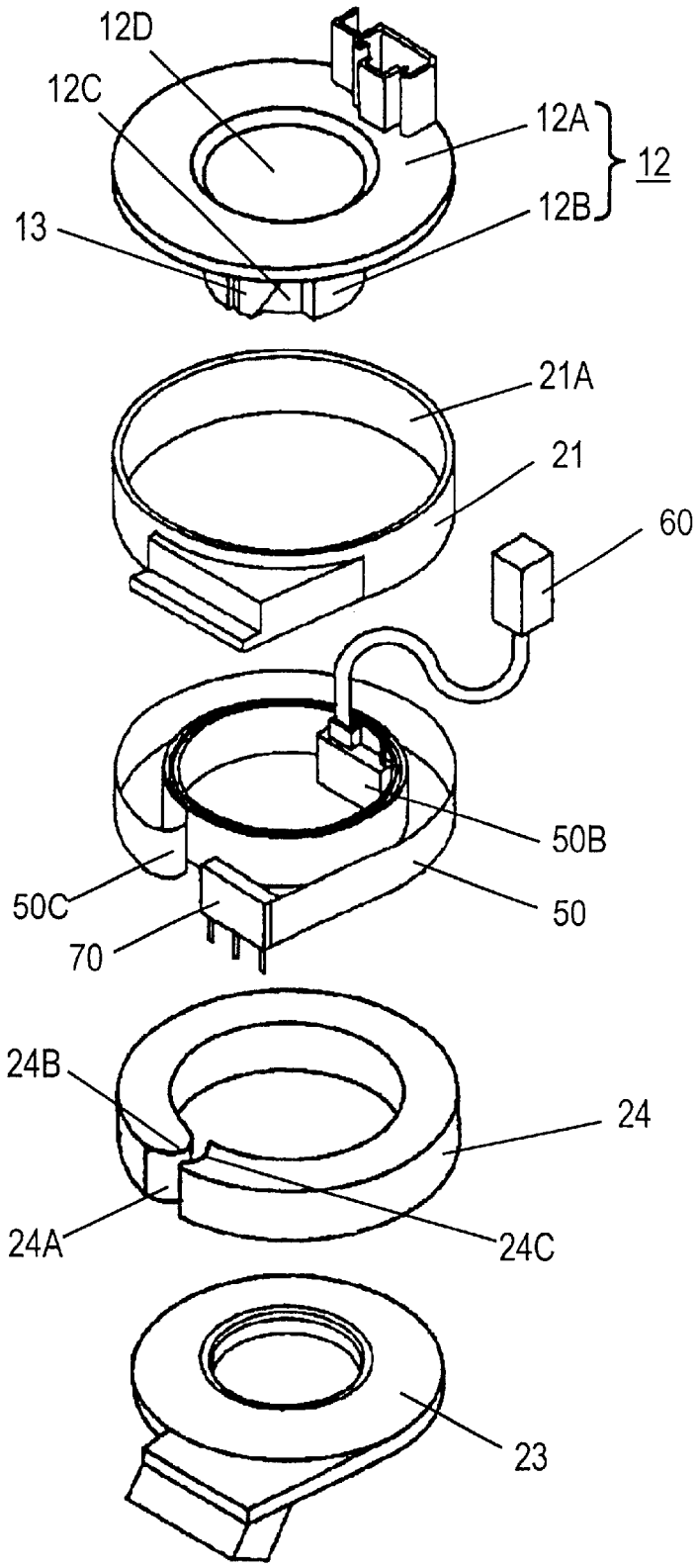
FIG. 8 shows an exploded perspective view of the rotary connector illustrated in FIG. 7.
Figure 9:
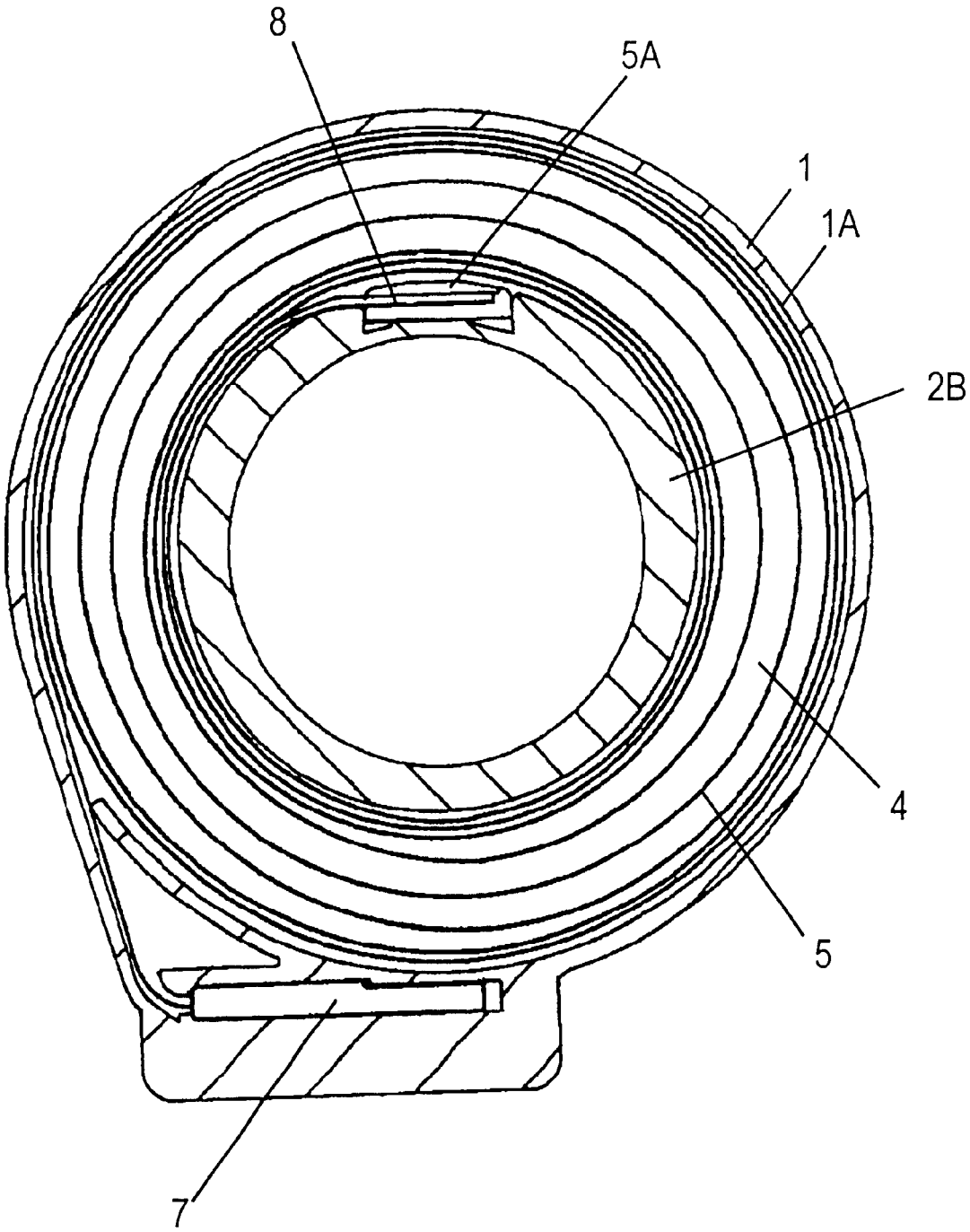
FIG. 9 PRIOR ART
FIG. 9 shows a cross-sectional view of a conventional rotary connector.
Figure 10:
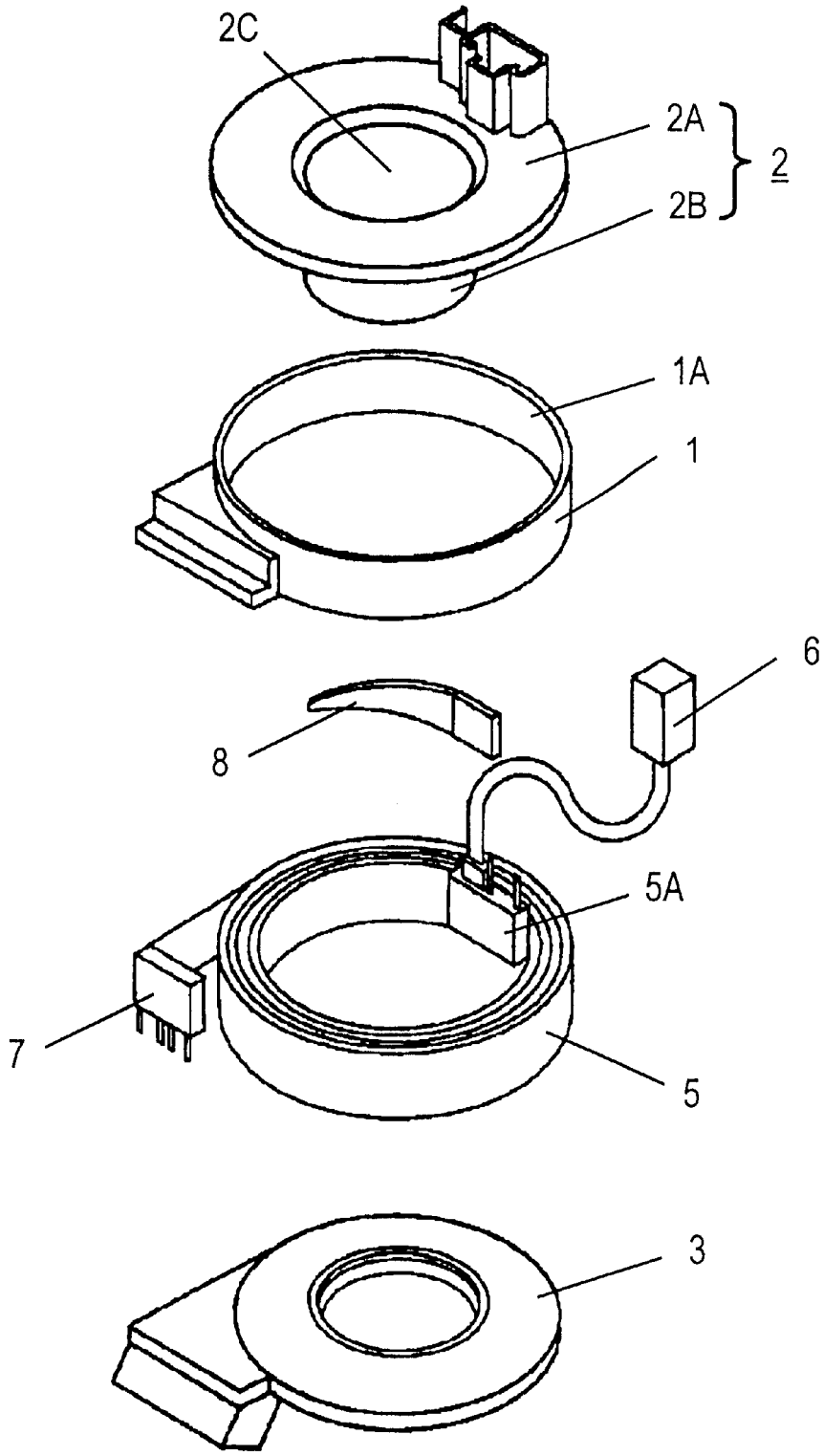
FIG. 10 PRIOR ART
FIG. 10 shows an exploded perspective view of the conventional rotary connector.
Figure 11:
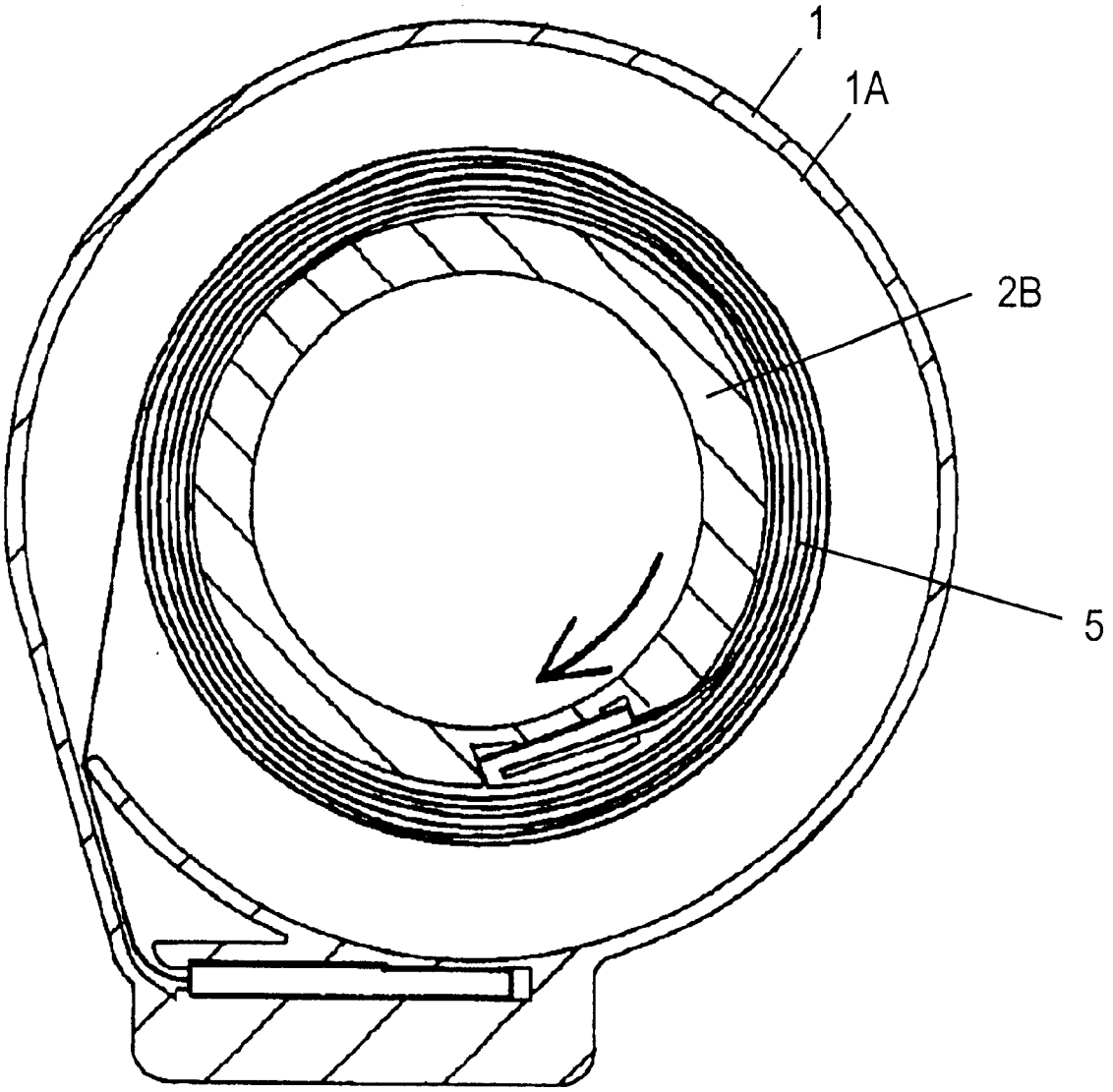
FIG. 11 PRIOR ART
FIG. 11 shows a cross-sectional view of the conventional rotary connector in which the flat cable is wound tightly.
Figure 12:
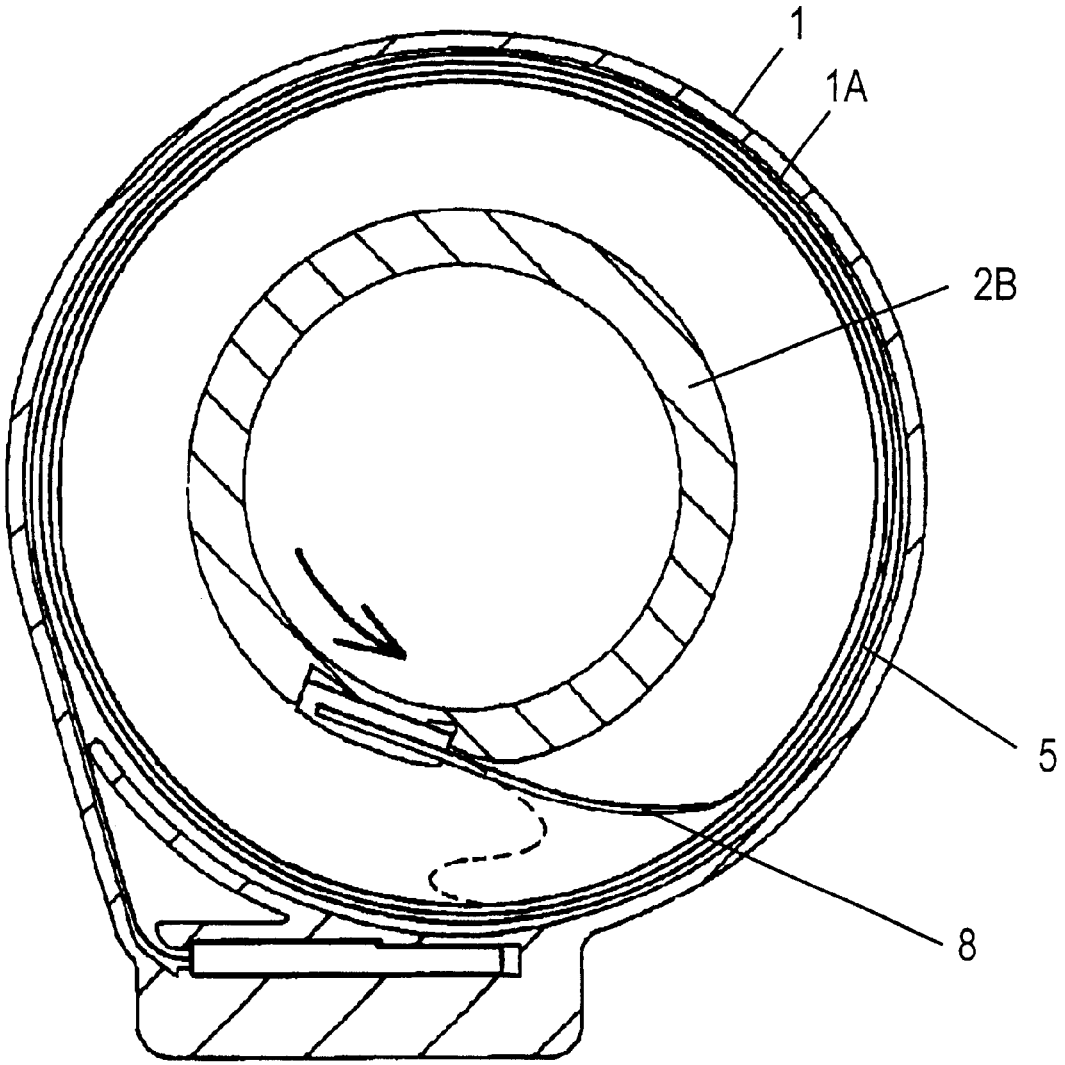
FIG. 12 PRIOR ART
FIG. 12 shows a cross-sectional vies of the conventional rotary connector in which the flat cable is rewound.

FIG. 7 shows a cross-sectional view of a rotary connector in accordance with a second preferred embodiment of the present invention. FIG. 8 shows an exploded perspective view of the rotary connector illustrated in FIG. 7.

The rotary connector of the second preferred embodiment, shown in FIGS. 7 and 8, is made of following components:

(a) cylindrical outer case 21 with the top and bottom surfaces open;

(b) inner case 12 accommodated in outer case 21 rotatably relative to outer case 21, (c) cover 23 fixed to outer case 21 to cover the bottom opening of the outer case 21;

(d) flexible flat cable 50 with reversed portion 50C formed, which is housed in ring-shaped space 4 that is defined by outer case 21 and inner case 12; and (e) guide-ring 24, which has guide-gap 24A through which reversed portion 50C of flat cable 50 is inserted, is accommodated in ring-shaped space 4.

In regard to the structure described below, the rotary connector of the embodiment is no different from that of the first embodiment, that is:

(a) cylindrical outer case 21 with the top and bottom surface open;

(b) cover 23 is fixed to outer case 21, covering the bottom opening of outer case 21;

(c) inner case 12 is provided with lid 12A covering the top opening of outer case 1, and with inner cylinder 12B having shaft hole 12D protruding downwardly from the center of the rear surface of the lid 12A;

(d) ring-shaped space 4 is formed between inner wall 21A of outer case 21 and inner cylinder 12B of inner case 12;

(e) guide piece 13 is formed at recess 12C disposed on inner cylinder 12B of inner case 12, having its one end formed in one piece with the bottom surface of lid 12A of inner case 12;

(f) A proximity area to the inside end of flat cable 50 is inserted into gap 14 that is formed between the periphery of recess 12C of inner cylinder 12B and the inner wall of guide piece 13;

(g) edge portion 13A of circumferentially directed tip of guide piece 13, tilting in the periphery of guide piece 13 direction, from which flat cable 50 is guided out;

(h) terminal 50B fixed to inner case 12 is disposed at the inside end of flat cable 50;

(i) terminal 50B is coupled to inner connector 60;

(j) inner connector 60 is coupled to an electric circuit within the steering wheel;

(k) outer connector 70 fixed to outer case 21 is coupled to the outside end of flat cable 50; and (l) outer connector 70 is coupled to an external electric circuit.

The structural difference from the first preferred embodiment is, according to the rotary connector of the second embodiment, in employing guide-ring 24 and flat cable 50 having U-shaped reversed portion 50C. To be precise, flat cable 50 having U-shaped reversed portion 50C is housed in ring-shaped space 4. With reversed portion 50C, the winding on the side of the proximity to inner wall 21A of outer case 21 is opposite in direction to the winding on the side of the proximity to inner cylinder 12B of inner case 12.

Guide-ring 24 having guide-gap 24A through which reversed portion 50C of flat cable 50 is inserted is rotatably accommodated, as well as flat cable 50, in ring-shaped space 4.

In the rotary connector of the second preferred embodiment structured above, outer case 21 is secured to the steering column (not shown) of an automobile. The steering wheel shaft (not shown) is inserted into shaft hole 12D of inner cylinder 12B of inner case 12. In this manner, the rotary connector of the second preferred embodiment is attached to the steering device in a car body. Outer connector 70, which is fixed to outer case 21, is coupled to an electric circuit in the steering column on the side of a car body, while inner connector 60, which is fixed to inner case 12, is coupled to an electric circuit within the steering wheel. An electric connection between the steering wheel and the steering column is thus established via flat cable 50. In regard to such workings, there is no difference between the first and the second embodiments.

Now will be described how the rotation of steering wheel effects the winding state of flat cable 50 in the rotary connector structured above in accordance with the second preferred embodiment.

FIG. 7 shows the state of flat cable 50 being wound evenly on the side of inner wall 21A of outer case 21 and the side of inner cylinder 12B of inner case 12. In this state, the steering wheel is held at a neutral position.

Rotating the steering wheel from the neutral position rotates inner case 12 attached to the steering wheel shaft. The rotation of the steering wheel changes the winding state of flat cable 50. As the steering wheel rotates, guide-ring 24 also rotates, responsive to reeled or unreeled flat cable 50, in the same direction with inner case 12. As inner case 12 rotates, flat cable 50 is guided by guide-gap 24A of guide-ring 24 through which reversed portion 50C is inserted. As a result, flat cable 50 is wound, responsive to the rotation of the steering wheel, on the side of inner cylinder 12B of inner case 12 or the side of inner wall 21A of outer case 21. That is, when inner case 12 rotates in a clockwise direction, flat cable 50 is wound on the side of inner cylinder 12B of inner case 12. As flat cable 50 rotates, reversed portion 50C pushes side-wall 24B of guide-gap 24A of guide-ring 24. This brings a clockwise rotation to guide-ring 24, so that the winding of flat cable 50 is in a tightened state. On the other hand, when inner case 12 rotates in a counterclockwise direction, flat cable 50 is unreeled from the side of inner cylinder 12B of inner case 12. Pushed side-wall 24C of guide-gap 24A by reversed portion 50C, guide-ring 24 now rotates in a counterclockwise direction, resulting that flat cable 50 is in a rewound state. The rotary connector of the second embodiment works in such way.

As described above, in ring-shaped space 4 formed between outer case 21 and inner case 12, flat cable 50, which is guided by guide-gap 24A of guide-ring 24 through which reversed portion 50C is inserted, changes its winding in opposite direction at reversed portion 50C. This structure advantageously saves the length of flat cable 50, comparing to that of a conventional rotary connector.

The present invention described above not only protects the flat cable from buckling or deformation, but also minimizes the number of parts. It is thus highly effective in providing an easy to assemble rotary connector with a low cost.

What is claimed is:

1. A rotary connector comprising:

a cylindrical outer case;

an inner case accommodated in the outer case rotatably relative to the outer case, having a lid covering a top opening of the outer case and also having an inner cylinder protruding downwardly from a center of a bottom surface of the lid;

a flexible flat cable having an inner end secured to the inner cylinder of the inner case, and having an outer end secured to the outer case;

a recess formed in the inner cylinder of the inner case closely to where the inner end of the flat cable is secured to the inner cylinder of the inner case;

a guide piece formed at the recess and having an end formed in one piece with the bottom surface of the lid of the inner case; and a gap formed between an inner wall of the guide piece and a periphery of the recess on the inner cylinder;

wherein an edge portion is formed on a tip of the guide piece so as to slant in a circumferential direction of the inner cylinder and so as to be non-parallel to a width direction of the flat cable; and wherein the flat cable is guided out from the gap formed between the periphery of the recess and the edge portion of the tip of the guide piece.

2. The rotary connector as defined in claim 1, wherein one end of the guide piece is formed in one piece with a periphery of the inner cylinder of the inner case.

3. The rotary connector as defined in claim 1, wherein a circular arc shaped periphery of the guide piece is disposed along a periphery of the inner cylinder.

4. The rotary connector as defined in claim 1, wherein an inner end portion of the flat cable passes through the gap.

5. The rotary connector as defined in claim 1, wherein a joint between the periphery of the recess and the periphery of the inner cylinder is shaped to be linear or in a circular arc with a gentle slope.

6. The rotary connector as defined in claim 1, wherein an elastic member is disposed in the gap between the periphery of the recess and the inner wall of the guide piece so that the elastic member abuts elastically against an inner end portion of the flat cable.

7. The rotary connector as defined in claim 1, further comprising a terminal secured to the inner case and disposed at an inner end portion of the flat cable, and wherein a projected holder is formed in an exposed recess between the terminal and the guide piece on the periphery of the recess, along which the inner end portion of the flat cable is held.

8. The rotary connector as defined in claim 1, wherein the flat cable is accommodated in said outer case in a ring-shaped space defined by said inner case and said outer case.

9. The rotary connector as defined in claim 1, wherein the flat cable is accommodated in a space defined by the outer and inner cases and has a U-shaped reversed portion such that a winding of the flat cable on a side of an inner wall of the outer case and a winding of the flat cable on a side of the inner cylinder of the inner case are opposite in direction to each other, and a guide-ring with a guide-gap through which the reversed portion of the flat cable passes is rotatably accommodated in said space where the flat cable is accommodated.

10. The rotary connector as defined in claim 9, wherein a joint between the periphery of the recess and the periphery of the inner cylinder is shaped to be linear or in a circular arc with a gentle slope.

11. The rotary connector as defined in claim 9, wherein an elastic member is disposed in the gap between the periphery of the recess and the inner wall of the guide piece so that the elastic member abuts elastically against an inner end portion of the flat cable.

12. The rotary connector as defined in claim 9, further comprising a terminal secured to the inner case and disposed at an inner end portion of the flat cable, and wherein a projected holder is formed in an exposed recess between the terminal and the guide piece on the periphery of the recess, along which the inner end portion of the flat cable is held.

* * * * *